US006611245B1

(12) United States Patent
Edwards

(10) Patent No.: US 6,611,245 B1
(45) **Date of Patent: *Aug. 26, 2003**

(54) ACTIVE MATRIX ELECTROLUMINESCENT DISPLAY DEVICE

(75) Inventor: Martin J. Edwards, Crawley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 145 days.

This patent is subject to a terminal disclaimer.

(21) Appl. No.: 09/584,811

(22) Filed: May 31, 2000

(30) Foreign Application Priority Data

Jun. 25, 1999 (GB) ..... 9914807

(51) Int. Cl.[7] ..... G09G 3/30

(52) U.S. Cl. ..... 345/76; 345/58; 345/78; 345/90; 345/92; 345/204; 345/212; 315/169.1; 315/169.3

(58) Field of Search ..... 345/55, 58, 76–78, 345/87, 90, 92, 94, 98, 100, 204–206, 211–214; 315/163, 165, 166, 169.1–169.3

(56) References Cited

U.S. PATENT DOCUMENTS 5,670,792 A 9/1997 Utsugi et al.
5,856,813 A * 1/1999 Katayama et al. ..... 345/76
5,903,246 A * 5/1999 Dingwall ..... 345/46
5,940,053 A * 8/1999 Ikeda ..... 345/76
6,014,119 A * 1/2000 Staring et al. ..... 345/82
6,169,532 B1 * 1/2001 Sumi et al. ..... 345/212
6,188,375 B1 * 2/2001 Kagey ..... 345/76
6,204,834 B1 * 3/2001 Baker et al. ..... 315/169.1
6,288,695 B1 * 9/2001 Wood ..... 313/309
6,400,348 B1 * 6/2002 Young ..... 315/169.3

FOREIGN PATENT DOCUMENTS

EP 0717446 A2 6/1996 ..... H01L/27/15

* cited by examiner

*Primary Examiner*—Henry N. Tran

(57) ABSTRACT

An active matrix electroluminescent display device comprises an array of display pixels (4) arranged in rows and columns with each row of pixels sharing a common line, and with currents through the display elements of a row of pixels passing along the common line. Error values (e) are generated to correct the drive signals (V) for each pixel in a row of pixels, to correct for the different voltages appearing on the common line. These different voltages give rise to horizontal cross talk. The error values (e) are derived from a circuit (34) representing an additional row of pixels and associated with the driver circuitry (32), and result in updated drive signals (V').

18 Claims, 3 Drawing Sheets

ACTIVE MATRIX ELECTROLUMINESCENT DISPLAY DEVICE

This invention relates to active matrix electroluminescent display devices, comprising an array of electroluminescent display pixels arranged in rows and columns. The invention is particularly concerned with display devices in which rows of pixels share a common line, with currents through the display elements of the row passing along the common line.

Matrix display devices employing electroluminescent, light-emitting, display elements are well known. The display elements may comprise organic thin film electroluminescent elements, for example using polymer materials, or else light emitting diodes (LEDs) using traditional III–V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer.

Organic electroluminescent materials exhibit diode-like I–V properties, so that they are capable of providing both a display function and a switching function, and can therefore be used in passive type displays.

However, the invention is concerned with active matrix display devices, with each pixel comprising a display element and a switching device for controlling the current through the display elements. Examples of an active matrix electroluminescent display are described in U.S. Pat. No. 5,67,0792, the contents of which are incorporated herein by way of reference material.

A problem with display devices of this type arises from the fact that they have current driven display elements. Display devices of the type with which this invention is concerned include a common line on which the currents from all pixels in a row pass. Compounding currents from the pixels in a row give rise to different voltages along the common line. These voltages depend upon the currents through all pixels in the row, since these currents all pass to the common line. These different voltages give rise to undesired changes to the outputs from the display pixels, which vary as a function of the full set of signals applied to the row. Consequently, there is cross-talk between the pixels within the row.

According to the invention, there is provided an active matrix electroluminescent display device comprising:

an array of display pixels arranged in rows and columns, each pixel comprising an electroluminescent display element and a switching means for controlling the current through the display element based on a signal voltage applied to the pixel, each row of pixels sharing a common line, currents through the display elements of a row of pixels passing along the common line; and driver circuitry for generating signal voltages corresponding to desired outputs from the display elements, and for applying signal voltages to rows of pixels in sequence, wherein the device further comprises:

means for generating error values for each pixel in a row of pixels to be addressed, derived from a circuit representing an additional row of pixels and associated with the driver circuitry, and to which the signal voltages for the row of pixels to be addressed are applied;

means for updating the signal voltages for each pixel in the row of pixels to be addressed, where required, using the error values; and means for supplying the updated signal voltages to the pixels.

The display device of the invention includes a circuit representing an additional row of pixels, so that the signal voltages can be applied to the additional row, and the actual outputs from the display elements can be evaluated, to enable a discrepancy between the desired output and the actual output to be corrected. This discrepancy arises from the different voltages on the common line at each pixel, which depend upon the signal voltages for the row of pixels. The device of the invention can thereby compensate each pixel individually for signal distortions resulting from cross-talk between pixels within a row.

The voltages on the common line of the additional row of pixels, at the position of each pixel, may be supplied as the error signals to a combining element which updates the signal voltages. This arrangement specifically corrects for the resistance of the common signal line, which gives rise to the cross-talk described above.

The display element and the switching means are preferably arranged in series between a voltage supply line for the display elements and the common line, which acts as a current drain.

Each pixel may further comprise a charge storage element for holding a control voltage derived from the updated signal voltage on the switching means.

The invention also provides a method of driving an active matrix electroluminescent display device, comprising an array of electroluminescent display pixels arranged in rows and columns, each row of pixels sharing a common line, currents through the display pixels of a row passing along the common line, different voltages thereby being present at different points along the common line, the method comprising addressing rows of pixels in sequence, and for each row of pixels generating voltage signals for the pixels in the row, the generated voltage signals corresponding to desired pixel outputs, wherein the method further comprises:

generating error values based on the effect of the voltage signals on a circuit representing an additional row of pixels;

updating the signal voltages for each pixel in the row, where required, using the error values; and supplying the updated signal voltages to the pixels.

The invention will now be described by way of example, with reference to and as shown in the accompanying drawings, in which:

FIG. 1 shows part of an electroluminescent active matrix display device to which the invention may be applied;

FIG. 2 schematically illustrates the current flowing in a row of electroluminescent display pixels, to illustrate the cross-talk resulting from the common signal line;

The Figures are merely schematic and have not been drawn to scale. The same reference numbers are used throughout the figures to denote the same or similar parts.

Figure 1:
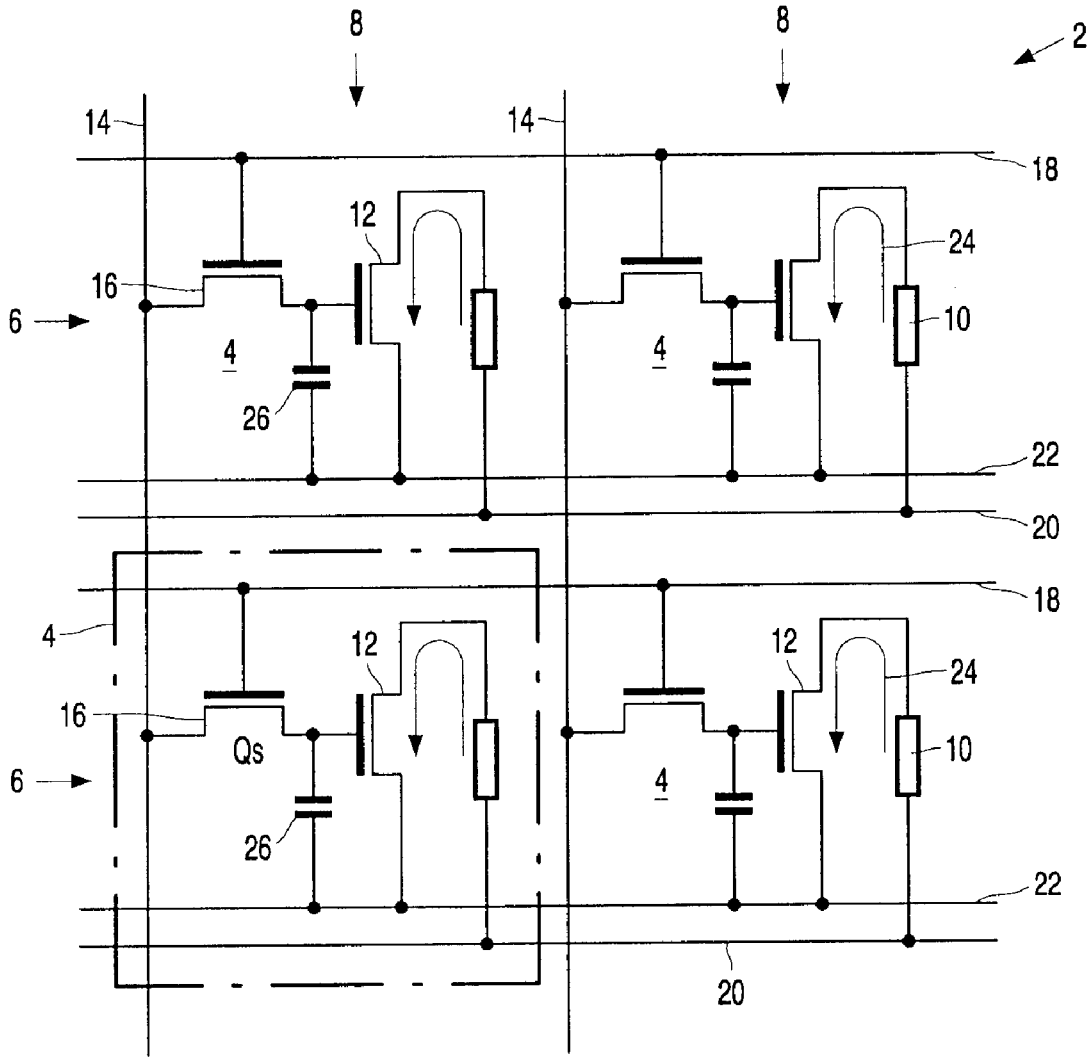

FIG. 1 shows a known pixel configuration for an electroluminescent active matrix display device. Various types of electroluminescent display devices are known, which utilise current-controlled electroluminescent or light emitting diode display elements. One example of the construction of such a display is described in detail in U.S. Pat. No. 5,670,792.

As shown schematically in FIG. 1, a display device 2 comprises an array of pixels 4 arranged in rows 6 and columns 8. Each pixel 4 comprises a display element 10 and a switching element 12 in a form of a thin film transistor, which controls the operation of the display element 10 based on a signal voltage applied to the pixel 4. As one example, the display element 10 comprises an organic light emitting diode comprising a pair of electrodes between which one or more active layers of organic electroluminescent material is sandwiched. At least one of the electrodes is formed of a transparent material such as ITO. Various electroluminescent materials are available, for example as described in EP-A-0717446.

The signal voltage for a pixel is supplied via a control signal line 14 which is shared between a respective column 8 of pixels. The control signal line 14 is coupled to the gate of the switching transistor 12 through an address transistor 16. The gates for the address transistors 16 of a row 6 of pixels are coupled together to a common address line 18.

Each row 6 of pixels 4 also shares a common voltage supply line 20 usually provided as a continuous common electrode covering all pixels, and a common signal line 22. The display element 10 and the switching element 12 are arranged in series between the voltage supply line 20 and the common signal line 22, which acts as a current drain for the current flowing through the display element 10, as represented by arrows 24. The current flowing through the display element 10 is controlled by the switching element 12 and is a function of the gate voltage on the transistor 12, which is dependent upon the control signals supplied to the control signal line 14.

A row of pixels is selected by applying a selection pulse to the address line 18 which switches on the address transistors 16 for the respective row of pixels. A voltage level derived from the video information is applied to the control signal line 14 and is transferred by the address transistor 16 to the gate of the switching transistor 12. During the periods when a row of pixels is not being addressed by the address line 18, the address transistor 16 is turned off, but the voltage on the gate of the switching transistor 12 is maintained by a pixel storage capacitor 26 which is connected between the gate of the switching transistor 12 and the common signal line 22. The voltage between the gate of the switching transistor 12 and the common signal line 22 determines the current passing through the display element 10 of the pixel 4. Thus, the current flowing through the display element is a function of the gate-source voltage of the switching transistor 12 (the source of the transistor 12 being connected to the common signal line 22, and the drain of the transistor 12 being connected to the display element 10). This current in turn controls the light output of the pixel.

The switching transistor 12 is arranged to operate in saturation, so that the gate-source voltage governs the current flowing through the transistor, irrespectively of the drain-source voltage. Consequently, slight variations of the drain voltage do not affect the current flowing through the display element 10. The voltage on the voltage supply line 20 is therefore not critical to the correct operation of the pixels. However, voltage fluctuations on the common signal line 22, which couples together the sources of the switching transistors 12, will influence the current flowing through the display element 10 for a given control voltage on the control signal line 14.

A problem therefore arises that the resistance of the common signal line 22 gives rise to voltage drops along that line, which voltage drops are a function of the currents supplied to the line from the individual pixels 10. The voltages on the common signal line 22 at the location of different pixels will depend in a complex manner on the currents passed by all of the pixels in the row. The gate-source voltage of the switching transistor 12 will depend upon the voltage on the common signal line 22 at the location of that pixel, so that these voltage variations will affect the brightness of the pixels. The result is non-uniformity and horizontal cross-talk of the picture information shown on the display.

This invention provides an electroluminescent display device in which the control signals are modified to correct the signals applied to the display elements. The modification of the control signal is to ensure that an appropriate gate-source voltage is applied to the switching transistor 12 to give rise to the desired display element output. The voltages occurring at different points within the pixels, for example the gate and source voltages of the TFTs, are not accessible to the column driver circuitry, which generates the control signals for the control signal lines 14.

Figure 2:
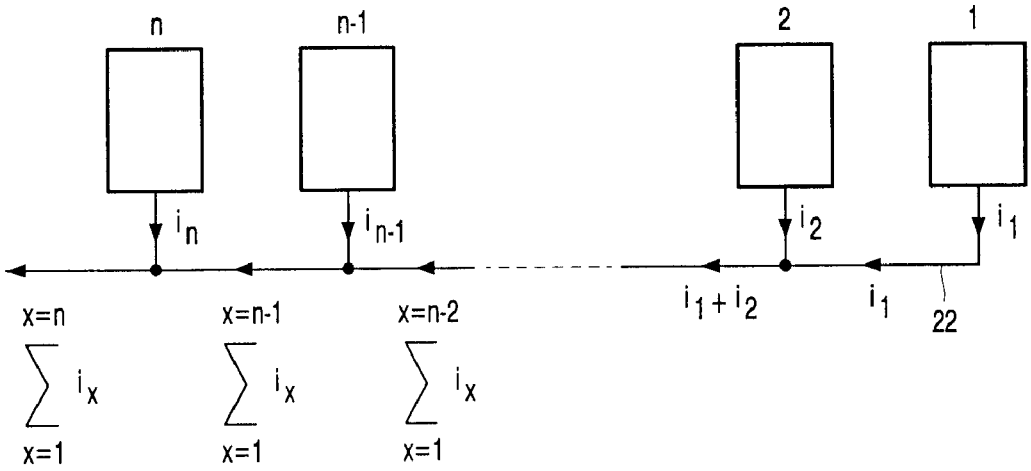

FIG. 2 shows the common signal line 22 with the currents $i_1, i_2, \ldots i_n$ associated with the pixels shown. These currents are the currents flowing through the pixels. A current summation occurs at each pixel location, as shown, and the voltage drop along each section of the common line 22 between adjacent pixels is a function of the current flowing in that section.

Figure 3:
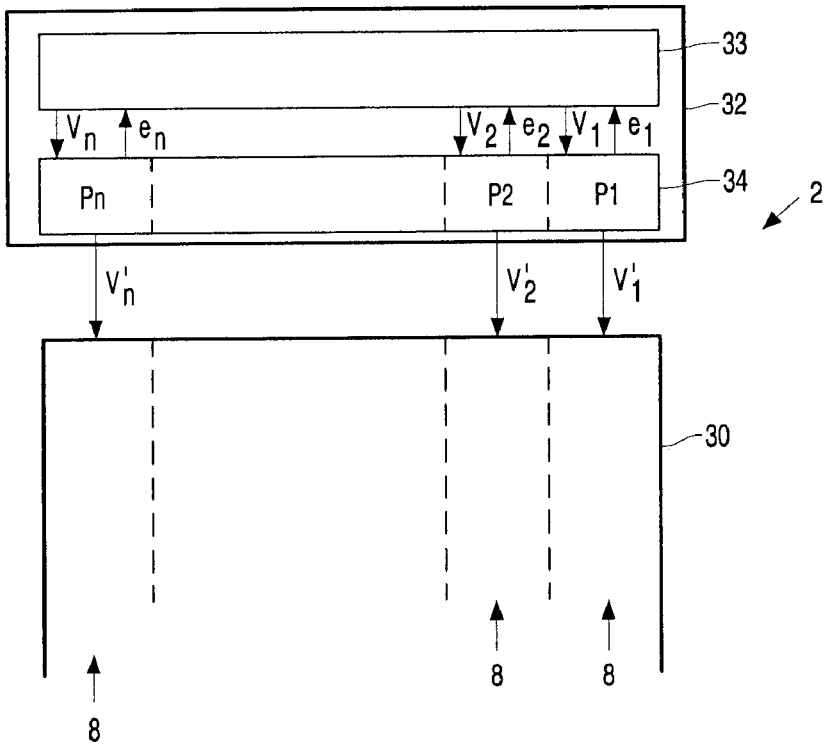
FIG. 3 shows a display device according to the invention.

FIG. 3 shows a display device according to the invention. The device 2 comprises a display area 30 which comprises pixels, for example as shown in FIG. 1 or 2. Driver circuitry 32 is provided which includes a conventional column driver unit 33 for generating signal voltages $V_1, V_2 \ldots V_n$ corresponding to desired outputs from the display elements. These signal values are determined from a video input signal to the display device which originates from separate circuitry and which arranges the data into a standard format. In accordance with the invention, the driver circuitry 32 includes an additional circuit 34 which represents an additional row of pixels P1, P2 . . . Pn and to which the signals $V_1, V_2 \ldots V_n$ are applied. Because the circuit 34 is provided in the driver circuitry 32 an analysis of the signals appearing within the pixels P1, P2 . . . Pn is possible, so that error values e1, e2, . . . en may be generated within the circuit 34 to enable updated signal voltages $V'_1, V'_2 \ldots V'_n$ to be supplied to the pixels in the display area 30.

These error values $e_1, e_2 \ldots e_n$ enable the updated signal voltages to take account of the different voltages on the common signal line 22 at each pixel, which voltages depend upon the signal voltages for the row of pixels. In this way, the updated signal voltages V' enable cross-talk between the pixels in a display area to be eliminated. Furthermore, any other effects giving rise to an incorrect voltage across the display element 10 will also be corrected.

Figure 4:
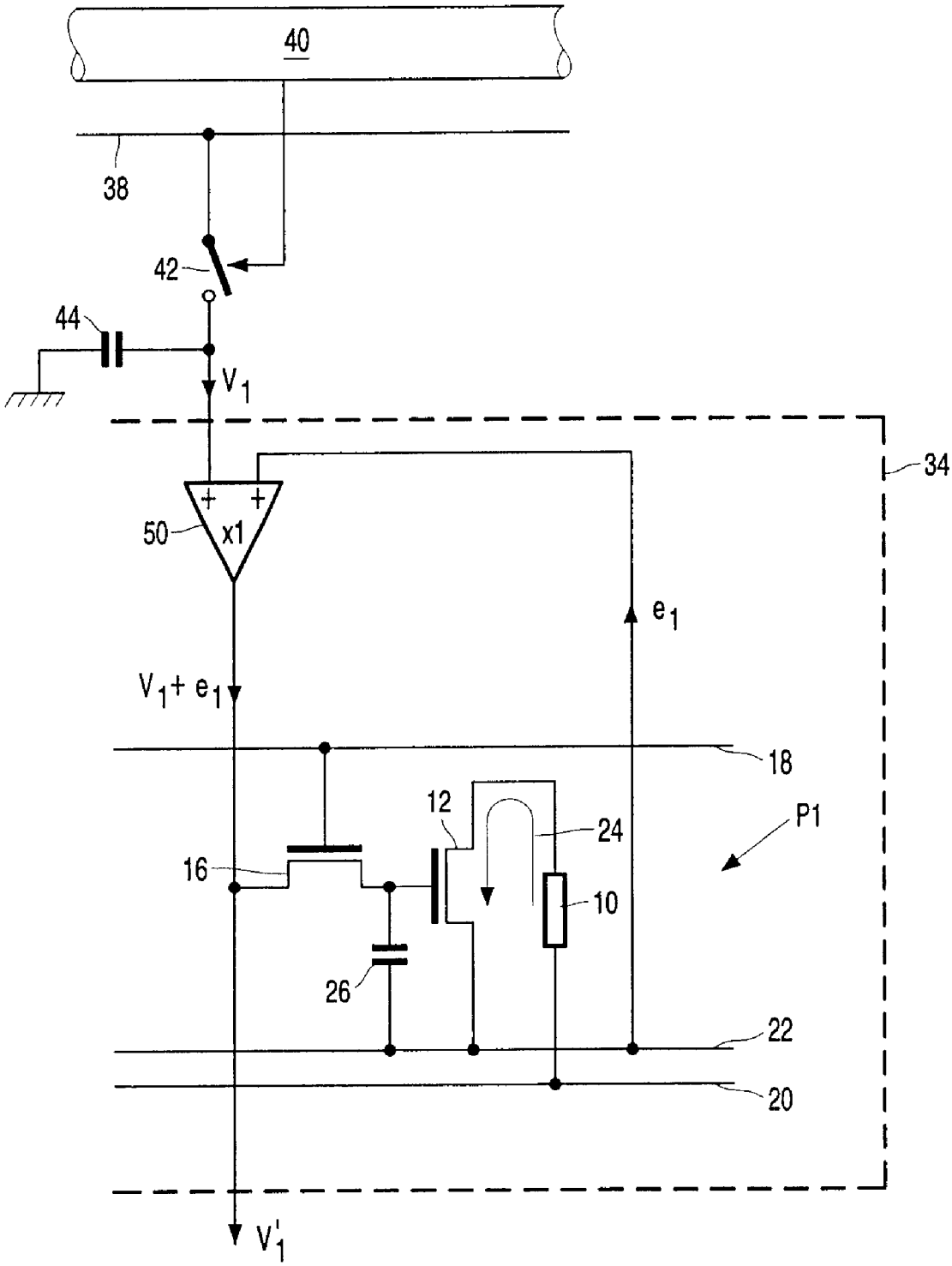
FIG. 4 shows in greater detail part of the device of FIG. 3.

FIG. 4 shows in greater detail one possible circuit for generating the error values e for modifying the signal voltages.

A single pixel P1 within the circuit 34 representing the additional row of pixels is shown in FIG. 4, This pixel P1 comprises a pixel configuration which is the same as the pixels used in the display device. In the example shown in FIG. 5 the pixel P1 has the same layout as the electroluminescent pixels shown in FIG. 1. Of course, the additional circuit 34 would represent liquid crystal pixels for a liquid crystal display.

A serial video signal is supplied to a data line 38, and the signals to be applied to each column in turn are taken from the data line 38 and supplied to the circuit 34 through a switch 42 operated under the control of a shift register 40.

The shift register 40 activates the switches 42 of the individual columns in turn so that the serial video data on the line 38 is supplied sequentially to each column in turn. The serial data line 38, the shift register 40 and the switches 42 may each be considered to comprise the conventional column driver circuitry 33. Each switch 42 is associated with a charge storage capacitor 44 which operates in combination with the switch 42 as a sample and hold circuit. The sampled voltage is supplied to a summing amplifier 50. The other input to the summing amplifier 50 is taken from the common signal line 22 and thereby comprises the voltage on the common signal line at the location of the respective pixel. This voltage may be considered to be an error signal $e_1$, particularly in the case where the common signal line 22 is connected to ground at one end. In such a case, the voltage supply line 20 may comprise a supply voltage of, for example, five volts, and this gives rise to the current flow represented by arrow 24.

The error voltage $e_1$ thus represents the amount by which the gate-source voltage of the switching transistor 12 is inadequate, as a result of the increased voltage on the common signal line 22, which results from the current flowing down the signal line. This is in turn a function of the voltages applied to the other pixels in the row for the electroluminescent display pixel arrangement shown. Adding the error voltage $e_1$ to the original signal voltage $V_1$ gives rise to a modified updated signal voltage $V'_1$ which is to be applied to the pixels of the display. An equilibrium state will be reached within the circuit 34 at which a voltage $V_1$ will be present as the gate-source voltage of the switching transistor 12, and this will thereby be repeated for the row of pixels being addressed in the display area 30.

For this scheme to work, the error values e generated in the circuit 34 representing the additional row of pixels must be the same as those resulting in the actual row of pixels in the display area 30. This should be the case in the example shown in FIG. 4 since the circuit 34 is derived from a replication of a row of pixels. It is, however, not necessary for the circuit 34 to be identical to the pixel circuits, but it merely needs to reproduce the error signals. For example, in the case of the circuit in FIG. 4 it may be possible to remove the addressing transistor 16, the storage capacitor 26 and the address line 18, and simply to connect the gate of the switching transistor 12 directly to the common signal. These changes may not affect the error values generated, depending upon the source-drain voltage drop across the address transistor 16.

Although a specific pixel configuration has been shown for an electroluminescent display device, various other pixel configurations will be apparent to those skilled in the art, and devices using those pixel configurations will benefit from the present invention, provided each row of pixels shares a common line which carries the currents from all pixels in the row. Similarly, one specific circuit for generating error values has been shown in FIG. 4, but of course different circuits for generating error values will be appropriate for different pixel configurations. These variations will all be apparent to those skilled in the art.

What is claimed is:

1. An active matrix electroluminescent display device comprising an array of display pixels arranged in rows and columns, each pixel comprising an electroluminescent display element and a switching means for controlling the current through the display element based on a signal voltage applied to the pixel, each row of pixels sharing a common line, currents through the display elements of a row of pixels passing along the common line, different voltages thereby being present at different points along the common line; and driver circuitry for generating signal voltages corresponding to desired outputs from the display elements, and for applying signal voltages to rows of pixels in sequence, characterized in that the device further comprises:

means for generating error values for each pixel in a row of pixels to be addressed, to compensate for said different voltages in said common line, derived from a circuit representing an additional row of pixels and associated with the driver circuitry, and to which the signal voltages for the row of pixels to be addressed are applied;

means for updating the signal voltages for each pixel in the row of pixels to be addressed, where required, using the error values; and means for supplying the updated signal voltages to the pixels.

2. A device as claimed in claim 1, wherein the display element and the switching means are arranged in series between a voltage supply line for the display elements and the common line, which acts as a current drain.

3. A display as claimed in claim 2, wherein an address line is associated with each row of pixels, and each pixel comprises an addressing switch which is controlled by the address line for switching the updated signal voltages to the switching means.

4. A display as claimed in claim 3, wherein each pixel further comprises a charge storage element for holding a control voltage derived from the updated signal voltage on the switching means.

5. A display as claimed in claim 3, wherein voltages on the common line of the additional row of pixels, at the positions of each pixel, are supplied as the error signals to a combining element which updates the signal voltages.

6. A display as claimed in claim 3, wherein all pixels of the array share a common voltage supply for the pixels.

7. A display as claimed in claim 2, wherein each pixel further comprises a charge storage element for holding a control voltage derived from the updated signal voltage on the switching means.

8. A display as claimed in claim 2, wherein voltages on the common line of the additional row of pixels, at the positions of each pixel, are supplied as the error signals to a combining element which updates the signal voltages.

9. A display as claimed in claim 2, wherein all pixels of the array share a common voltage supply for the pixels.

10. A display as claimed in claim 1, wherein each pixel further comprises a charge storage element for holding a control voltage derived from the updated signal voltage on the switching means.

11. A display as claimed in claim 10, wherein voltages on the common line of the additional row of pixels, at the positions of each pixel, are supplied as the error signals to a combining element which updates the signal voltages.

12. A display as claimed in claim 10, wherein all pixels of the array share a common voltage supply for the pixels.

13. A display as claimed in claim 1, wherein voltages on the common line of the additional row of pixels, at the positions of each pixel, are supplied as the error signals to a combining element which updates the signal voltages.

14. A display as claimed in claim 13, wherein all pixels of the array share a common voltage supply for the pixels.

15. A display as claimed in claim 1, wherein all pixels of the array share a common voltage supply for the pixels.

16. A display as claimed in claim 1, characterized in that said error values are error voltages.

17. A method of driving an active matrix electroluminescent display device comprising an array of electroluminescent display pixels arranged in rows and columns, each row of pixels sharing a common line, currents through the display pixels of a row passing along the common line, different voltages thereby being present at different points along the common line, the method comprising addressing rows of pixels in sequence, and for each row of pixels generating voltage signals for the pixels in the row, the generated voltage signals corresponding to desired pixel outputs, characterised in that the method further comprises:

generating error values based on the effect of the voltage signals on a circuit representing an additional row of pixels;

updating the signal voltages for each pixel in the row, where required, using the error values; and supplying the updated signal voltages to the pixels.

18. A method as claimed in claim 17, where in said updating the signal voltages comprises combining the respective error values with the respective signal voltages to form said updated signal voltages.

* * * * *